US008051692B2

(12) United States Patent
Hayashi et al.

(10) Patent No.: US 8,051,692 B2
(45) Date of Patent: Nov. 8, 2011

(54) SHAPE DETECTION DEVICE AND SHAPE DETECTION METHOD

(75) Inventors: Kanji Hayashi, Hiroshima (JP); Shigeki Sueda, Hiroshima (JP); Hideaki Furumoto, Hiroshima (JP); Junichi Nishizaki, Hiroshima (JP); Yoichiro Tsumura, Hiroshima (JP); Nobuyoshi Goshima, Hiroshima (JP)

(73) Assignee: Mitsubishi-Hitachi Metals Machinery, Inc., Tokyo (JP)

( * ) Notice: Subject to any disclaimer, the term of this patent is extended or adjusted under 35 U.S.C. 154(b) by 967 days.

(21) Appl. No.: 11/919,489

(22) PCT Filed: Mar. 10, 2006

(86) PCT No.: PCT/JP2006/304756

§ 371 (c)(1),
(2), (4) Date: Jan. 16, 2008

(87) PCT Pub. No.: WO2006/134695

PCT Pub. Date: Dec. 21, 2006

(65) Prior Publication Data

US 2008/0134739 A1 Jun. 12, 2008

(30) Foreign Application Priority Data

Jun. 17, 2005 (JP) ..... 2005-177221

(51) Int. Cl.
*B21B 37/28* (2006.01)
*B21B 38/00* (2006.01)

(52) U.S. Cl. ..... 72/9.1; 72/31.09

(58) Field of Classification Search ..... 72/8.1, 72/8.3, 9.1, 11.7, 31.09, 365.2
See application file for complete search history.

(56) References Cited

U.S. PATENT DOCUMENTS 4,188,809 A * 2/1980 Ishimoto et al. ..... 72/11.4

FOREIGN PATENT DOCUMENTS

| | | | |
|---|---|---|---|
| JP | 5-86290 | A | 4/1993 |
| JP | 8-215728 | A | 8/1996 |
| JP | 10-314821 | A | 12/1998 |
| JP | 2003-504211 | A | 2/2003 |
| JP | 2004-309142 | A | 11/2004 |
| WO | WO-01/05530 | A1 | 1/2001 |

* cited by examiner

*Primary Examiner* — Teresa Ekiert
(74) *Attorney, Agent, or Firm* — Birch, Stewart, Kolasch & Birch, LLP

(57) ABSTRACT

A shape detection device capable of detecting meandering of a strip with high accuracy and a method thereof. The device includes a plurality of split rolls provided in a width direction of a rolling material; a table which guides the rolling material and which is rotatably supported; a fixing member supported by the table; torque detectors for separately detecting loads acting on both ends of the split rolls when the rolling material comes in contact with the split roll as moments; supporting arms of which one end rotatably supports the split roll and the other end is supported by the fixing member through the torque detectors; a meandering amount computing unit for computing a meandering amount of the rolling material using the moments detected by the torque detectors, and a plate shape computing unit for computing a plate shape of the rolling material using the moments and the meandering amount.

5 Claims, 6 Drawing Sheets

[FIG.1]
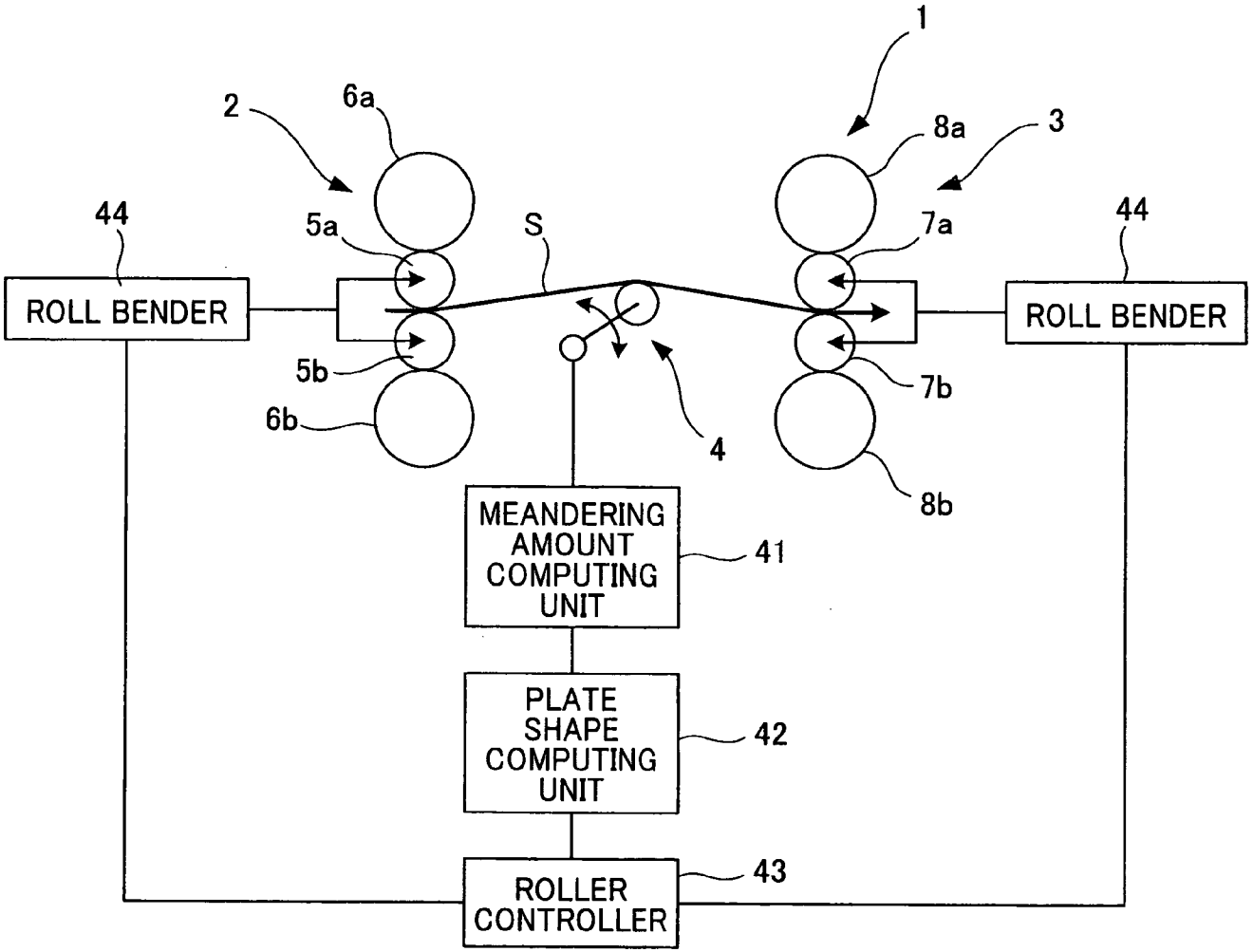

[FIG.2]
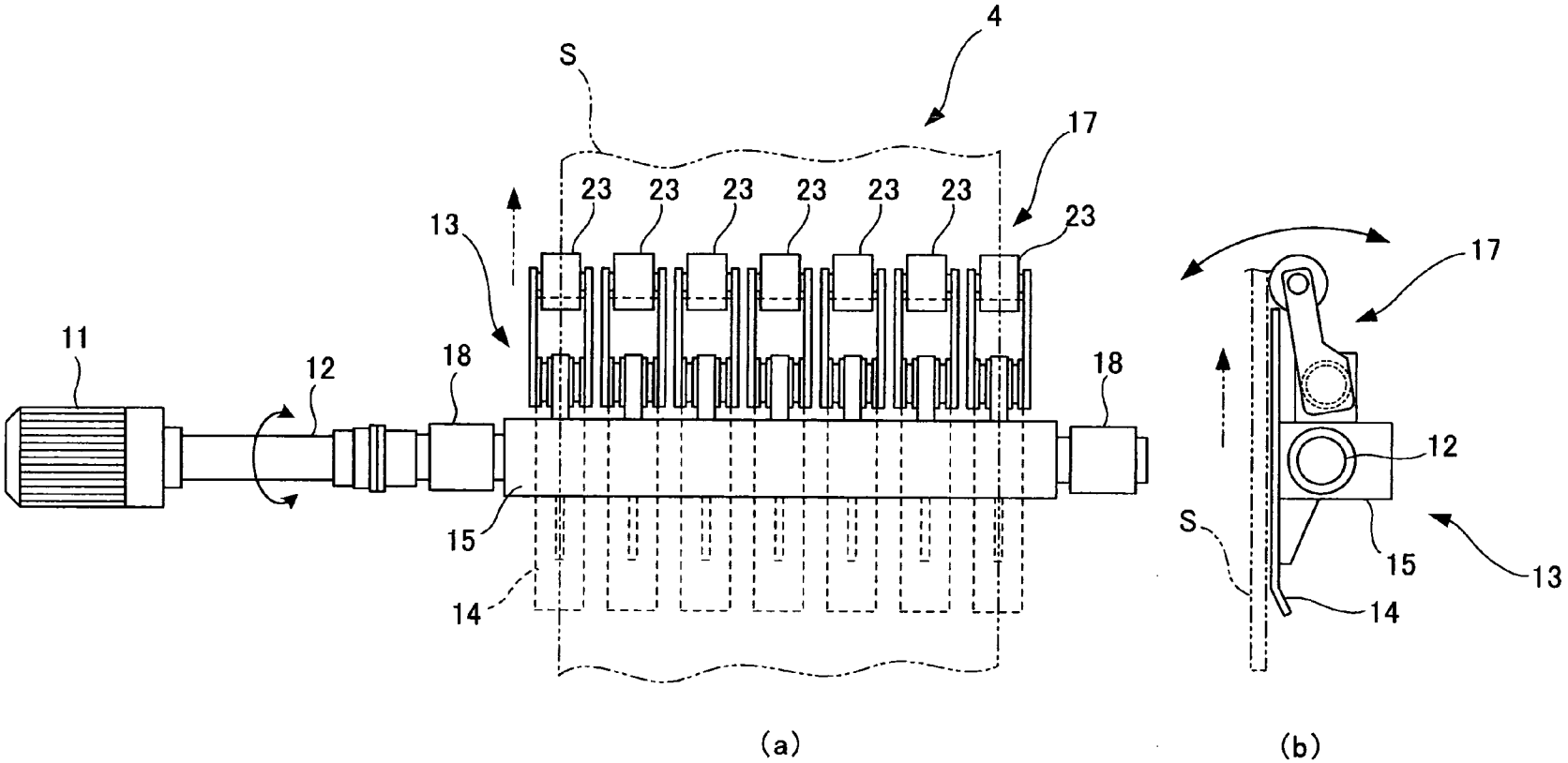

[FIG.3]
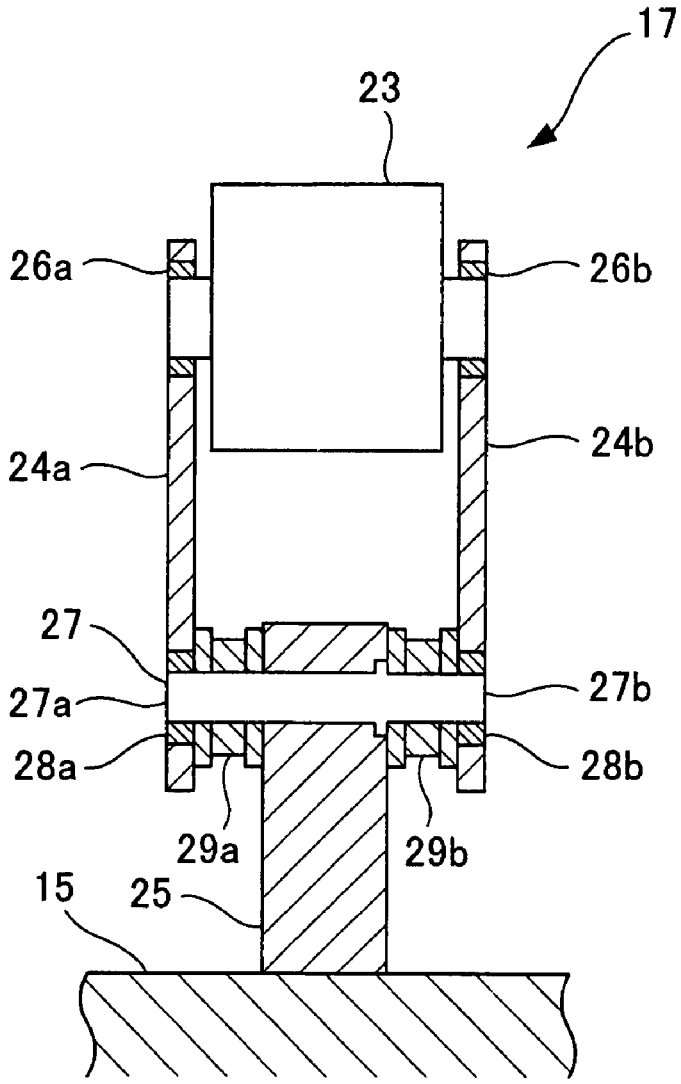

[FIG.4]
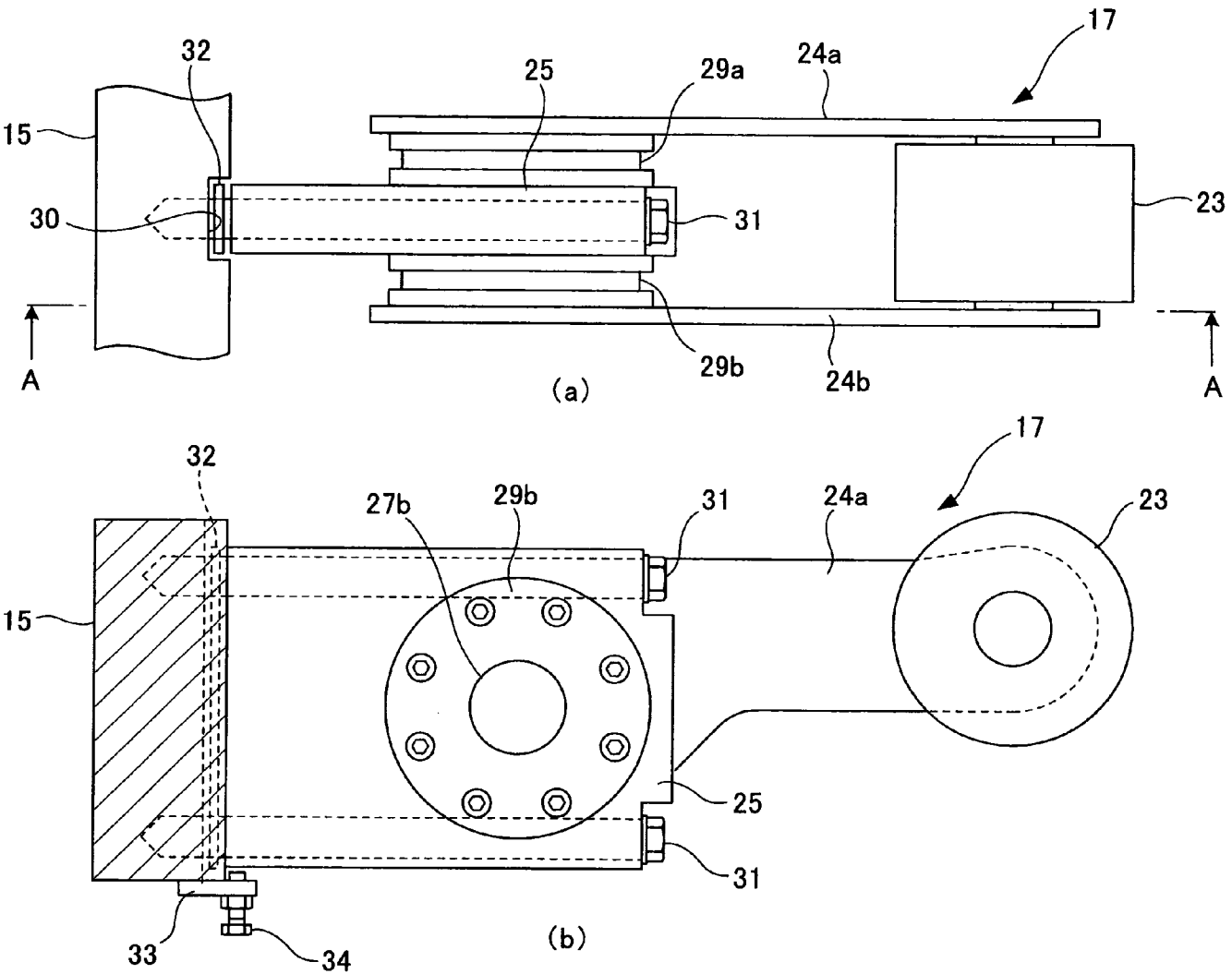

[FIG.5]
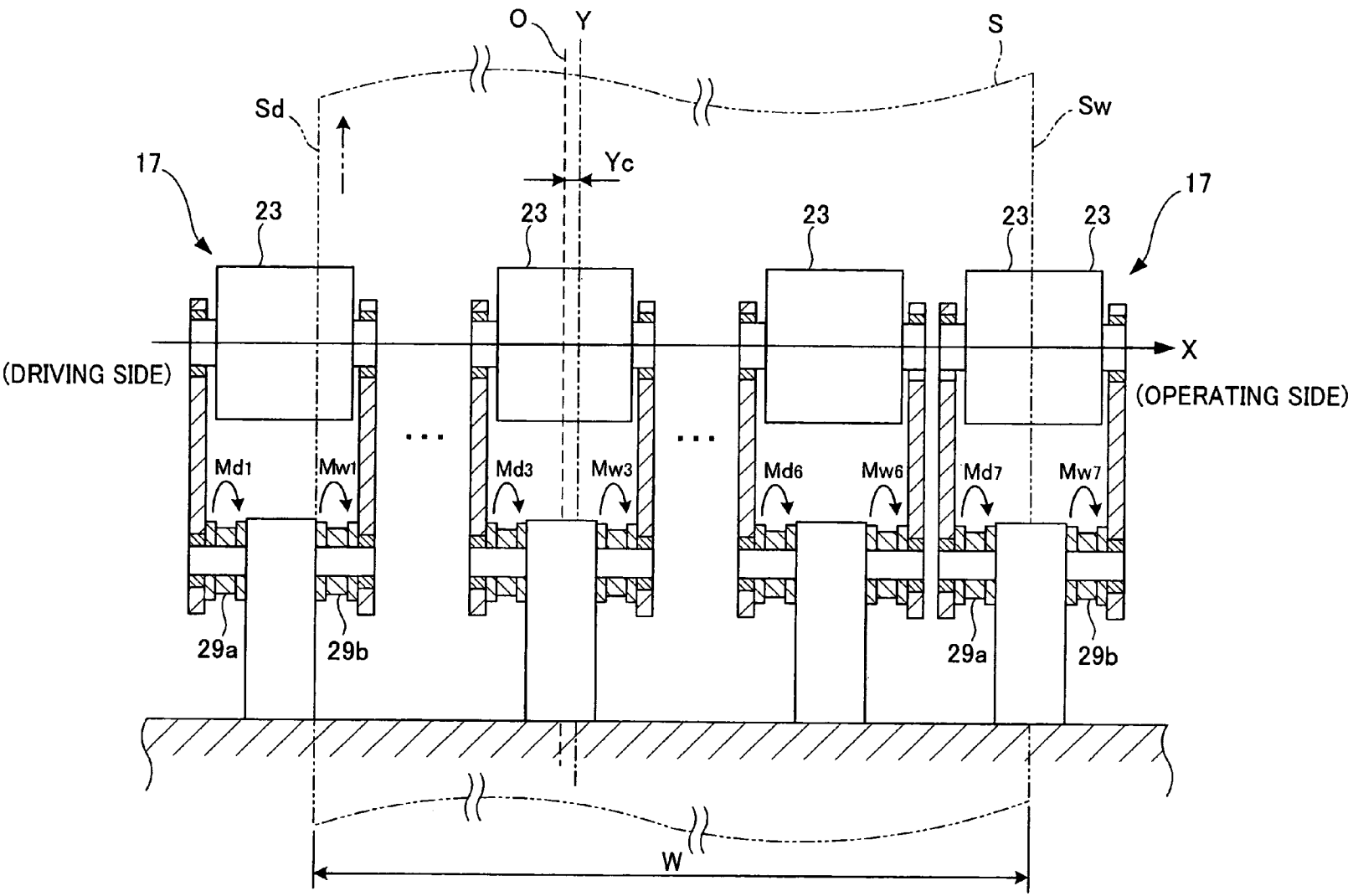

[FIG.6]
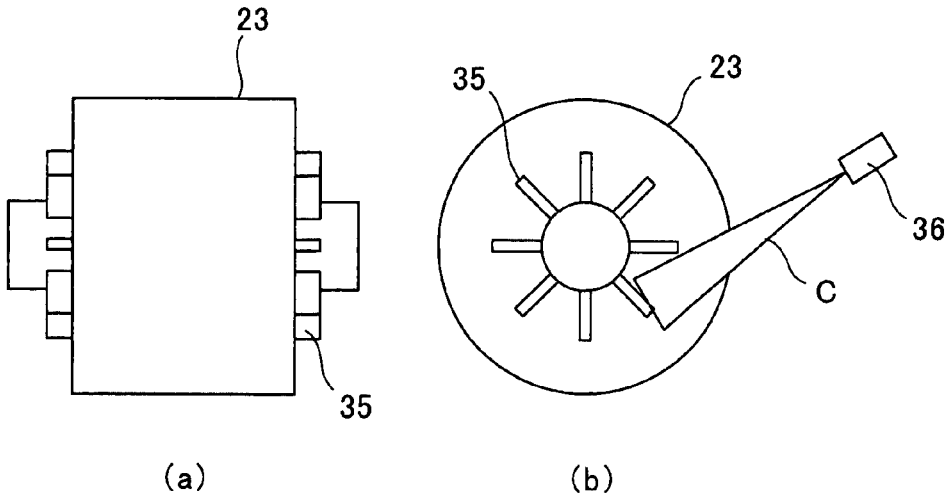
[FIG.7]
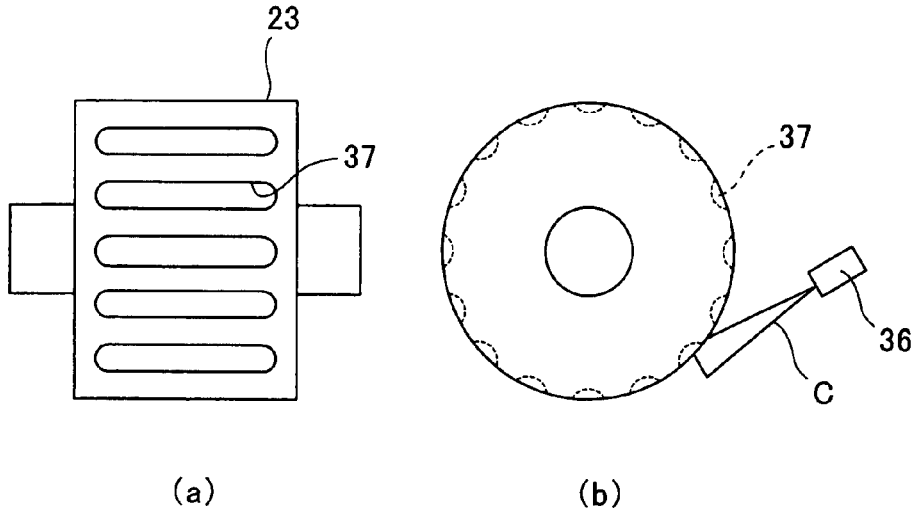

SHAPE DETECTION DEVICE AND SHAPE DETECTION METHOD

TECHNICAL FIELD

The present invention relates to a shape detection device and a method of detecting a shape.

BACKGROUND ART

A shape detection device is arranged between stands of a multistage rolling mill. To synchronize rolling speeds of the stands, a rolling material is threaded on rolls which are rotatably supported and the rolls are oscillated in upper and lower directions, so that the rolling material can have a loop to apply a certain tension. Then, a plate shape (plate thickness) of the rolling material is computed on the basis of the detected tension distribution in the width direction of the rolling material to control the roller. With this, the shape in the width direction of the rolling material can be uniform, so that edge waves, intermediate elongation, and the like can be prevented.

Such a conventional shape detection device is disclosed in Patent Documents 1 to 4.

Patent Document 1: Japanese Patent Application Laid-open No. Hei10-314821

Patent Document 2: Japanese Patent Translation Publication No. 2003-504211

Patent Document 3: Japanese Examined Patent Publication No. Hei5-86290

Patent Document 4: Japanese Patent Application Laid-open No. 2004-309142

DISCLOSURE OF THE INVENTION

Problems to be Solved by the Invention

However, in conventional shape detection devices, only a plate shape of a rolling material was detected and a meandering amount of the rolling material (an off-line amount of the center position in the width direction of the rolling material in relation to the traveling center position within the rolling mill) was not detected. As for rolling, a plate shape as well as a meandering amount of the rolling material has to be considered at the same time. That is, since there is a case where the plate shape is a predetermined shape but the rolling material is meandering, or a case where the plate shape is not a predetermined shape and the rolling material is not meandering, the rolling mill has to be controlled according to the plate shape and the meandering amount. In addition, suppose a case the meandering of the rolling material is not controlled. In that case, when a tail portion of the meandered rolling material tails out from the stand, the rolling material comes in contact with the guide of the roller. As a result, the rolling material is bent, and there is a possibility of causing a drawing accident that damages rolling rolls of the next stand.

That is, in a case where rolling is performed by using the conventional shape detection device, there is a problem of increasing costs because additional equipment such as a meandering detector for detecting the meandering amount of the rolling material is needed. In addition, in the conventional shape detection device, when an excessive relative velocity deviation is generated between the stands, the rolls move up and down. As a result, an excessive impact is added to a tension detecting portion, and there is a possibility of shortening the life of the shape detection device. Furthermore, since the fastening force of a bolt or the like is always applied to the tension detecting unit, there is caused a hysteresis problem that causes a difference between an actual tension and the detected tension, resulting in deteriorating detection accuracy.

Accordingly, the present invention has been made to solve the above-mentioned problems, and an object of the present invention is to provide a shape detection device capable of detecting meandering of a strip with high accuracy and is to provide a method achieving such detection device.

Means for Solving the Problems

A shape detection device according to a first invention of the present invention to solve the above-mentioned problems is characterized by including:

a plurality of split rolls provided in the width direction of a traveling strip;

a table which guides the strip and which is rotatably supported;

a fixing member supported by the table;

a reactive force detector for separately detecting reactive forces acting on both ends of the split rolls when the strip comes in contact with the split rolls;

a supporting arm, one end of which rotatably supports the split roll and the other end of which is supported by the fixing member through the reactive force detector;

a meandering amount computing unit for computing a meandering amount of the strip on the basis of the reactive forces detected by the reactive force detector; and a plate shape computing unit for computing a plate shape on the basis of the reactive forces detected by the reactive force detector and the meandering amount computed by the meandering amount computing unit.

A rolling mill according to a second invention of the present invention to solve the above-mentioned problems is characterized by including:

a plurality of split rolls provided in the width direction of a traveling rolling material;

a table which guides the rolling material and which is rotatably supported;

a fixing member supported by the table;

a reactive force detector for separately detecting reactive forces acting on both ends of the split rolls when the rolling material comes in contact with the split rolls;

a supporting arm, one end of which rotatably supports the split roll and of the other end of which is supported by the fixing member through the reactive force detector;

a meandering amount computing unit for computing a meandering amount of the rolling material on the basis of the reactive forces detected by the reactive force detector;

a plate shape computing unit for computing a plate shape of the rolling material on the basis of the reactive forces detected by the reactive force detector and the meandering amount computed by the meandering amount computing unit; and a control actuator for controlling meandering and a shape of the rolling material according to the meandering amount computed by the meandering amount computing unit and the plate shape computed by the plate shape computing unit.

A shape detecting method according to a third invention of the present invention to solve the above-mentioned problems is characterized by including:

bringing a plurality of split rolls provided in the width direction of a traveling strip into contact with the strip; separately detecting reactive forces acting on both ends of the split rolls for each split roll; obtaining a meandering amount of the strip on the basis of these separately-detected reactive forces;

and obtaining a plate shape of the strip based on the detected reactive forces and the meandering amount.

A rolling method according to a fourth invention of the present invention to solve the above-mentioned problems is characterized by including:

bringing a plurality of split rolls provided in the width direction of a traveling rolling material into contact with the traveling rolling material; separately detecting reactive forces acting on both ends of the split rolls for each split roll; obtaining a meandering amount of the rolling material from these separately-detected reactive forces; obtaining a plate shape of the rolling material from the detected reactive forces and the meandering amount; and controlling meandering and a shape of the rolling material according to the meandering amount and the plate shape.

A rolling method according to a fifth invention of the present invention is characterized in that in the rolling method according to the fourth invention of the present invention, the plate shape is approximated to a polynomial of a tension distribution in the plate width direction of a rolling direction tension by using the meandering amount; and meandering and a shape of the rolling material is controlled using the polynomial and the meandering amount.

Effects of the Invention

The shape detection device according to the first invention of the present invention is provided with a plurality of split rolls provided in the width direction of a traveling strip; a table which guides the strip and which is rotatably supported; a fixing member supported by the table; a reactive force detector for separately detecting reactive forces acting on both ends of the split rolls when the strip comes in contact with the split rolls; a supporting arm, one end of which rotatably supports the split roll and the other end of which is supported by the fixing member through the reactive force detector; a meandering amount computing unit for computing a meandering amount of the strip on the basis of the reactive forces detected by the reactive force detector; and a plate shape computing unit for computing a plate shape of the strip on the basis of the reactive forces detected by the reactive force detector and the meandering amount computed by the meandering amount computing unit. With this, the meandering and plate shape of the strip can be detected with high accuracy.

The rolling mill according to the second invention of the present invention is provided with a plurality of split rolls provided in a width direction of a traveling rolling material; a table which guides the rolling material and which is rotatably supported; a fixing member supported by the table; a reactive force detector for separately detecting reactive forces acting on both ends of the split rolls when the rolling material comes in contact with the split rolls; a supporting arm, one end of which rotatably supports the split roll and the other end of which is supported by the fixing member through the reactive force detector; a meandering amount computing unit for computing a meandering amount of the rolling material on the basis of the reactive forces detected by the reactive force detector; a plate shape computing unit for computing a plate shape of the rolling material on the basis of the reactive forces detected by the reactive force detector and the meandering amount computed by the meandering amount computing unit; and a control actuator for controlling meandering and a shape of the rolling material according to the meandering amount computed by the meandering amount computing unit and the plate shape computed by the plate shape computing unit. With this, the meandering and plate shape of the rolling material can be controlled with high accuracy, so that the drawing accident can be prevented.

The shape detecting method according to the third invention of the present invention includes bringing a plurality of split rolls provided in the width direction of a traveling strip into contact with the strip; separately detecting reactive forces acting on both ends of the split rolls for each split roll; obtaining a meandering amount of the strip on the basis of these separately-detected reactive forces; and obtaining a plate shape of the strip according to the detected reactive forces and the meandering amount. With this, the meandering and plate shape of the strip can be detected with high accuracy.

The rolling method according to the fourth invention of the present invention includes bringing a plurality of split rolls provided in the width direction of a traveling rolling material into contact with the traveling rolling material; separately detecting reactive forces acting on both ends of the split rolls for each split roll; obtaining a meandering amount of the rolling material from these separately-detected reactive forces; obtaining a plate shape of the rolling material from the detected reactive forces and the meandering amount; and controlling meandering and a shape of the rolling material according to the meandering amount and the plate shape. With this, the meandering and plate shape of the rolling material can be controlled with high accuracy, so that the drawing accident can be prevented.

The rolling method according to the fifth invention of the present invention includes that in the rolling method according to the fourth invention of the present invention, the plate shape is approximated to a polynomial of a tension distribution in a plate width direction of a rolling direction tension by using the meandering amount and the meandering and shape of the rolling material is controlled using the polynomial and the meandering amount. With this, the rolling material with high accuracy can be produced.

BRIEF DESCRIPTION OF THE DRAWINGS

FIG. 1 is a schematic view of a rolling mill according to one embodiment of the present invention.

FIG. 2(*a*) is a plan view of a shape detection device, and FIG. 2(*b*) is a side view of FIG. 2(*a*).

FIG. 3 is an enlarged cross-sectional view of the detector.

FIG. 4(*a*) is a plan view showing an attachment structure of the detector, and FIG. 4(*b*) is a cross-sectional view as viewed from the direction of arrow A-A of FIG. 4(*a*).

FIG. 5 is a schematic view showing operations at the time of detecting moments.

FIG. 6(*a*) is a front view showing a cooling structure of a split roll, and FIG. 6(*b*) is a side view of FIG. 6(*a*).

FIG. 7(*a*) is a front view showing another cooling structure of the split roll, and FIG. 7(*b*) is a side view of FIG. 7(*a*).

REFERENCE NUMERALS

1 Rolling mill, 2 First-stage rolling stand, 3 Second-stage rolling stand, 4 Shape detection device, 5*a*, 5*b* Rolling roll, 6*a*, 6*b* Roll, 7*a*, 7*b* Rolling roll, 8*a*, 8*b* Roll, 11 Driving motor, 12 Supporting shaft, 13 Table, 14 Guiding member, 15 Guide supporting member, 17 Detector, 18 Bearing, 23 Split roll, 24*a*, 24*b* Supporting arm, 25 Fixing member, 26*a*, 26*b*, 28*a*, 28*b* Self-aligning bearing, 27 Supporting shaft, 27*a*, 27*b* End, 29*a*, 29*b* Torque detector, 30 Groove, 31 Fixing bolt, 32 Liner, 33 Supporting plate, 34 Height adjusting bolt, 35 Blade, 36 Cooling device, 37 Groove, 41 Meandering amount computing unit, 42 Plate shape computing unit, 43 Rolling controller, 44 Roll bender

BEST MODE FOR CARRYING OUT THE INVENTION

The description of one embodiment according to the present invention will be given below in detail on the basis of drawings. FIG. 1 is a schematic view of a rolling mill according to one embodiment of the present invention. FIG. 2(*a*) is a plan view of a shape detection device. FIG. 2(*b*) is a side view of FIG. 2(*a*). FIG. 3 is an enlarged cross-sectional view of the detector. FIG. 4(*a*) is a plan view showing an attachment structure of the detector. FIG. 4(*b*) is a cross-sectional view as viewed from the direction of arrow A-A of FIG. 4(*a*). FIG. 5 is a schematic view showing operations at the time of detecting moments. FIG. 6(*a*) is a front view showing a cooling structure of a split roll. FIG. 6(*b*) is a side view of FIG. 6(*a*). FIG. 7(*a*) is a front view showing another cooling structure of the split roll. FIG. 7(*b*) is a side view of FIG. 7(*a*). It is to be noted that an arrow in a figure shows the rolling direction.

As shown in FIG. 1, a rolling mill 1 is formed of a first-stage rolling stand 2, a second-stage rolling stand 3, and a shape detection device 4. The shape detection device 4 is provided between an outgoing side of the first-stage rolling stand 2 and an ingoing side of the second-stage rolling stand 3. Then, the first-stage rolling stand 2 is provided with rolling rolls 5*a* and 5*b* and rolls 6*a* and 6*b* supporting these rolling rolls 5*a* and 5*b*. Similarly, the second-stage rolling stand 3 is provided with rolling rolls 7*a* and 7*b* and rolls 8*a* and 8*b* supporting these rolling rolls 7*a* and 7*b*. In addition, the shape detection device 4 is connected with a meandering amount computing unit 41, a plate shape computing unit 42, and a rolling controller 43 in this order. The rolling controller 43 is connected with roll benders 44 (control actuators) of the rolling rolls 5*a* and 5*b* and the rolling rolls 7*a* and 7*b*. It is to be noted that S shows a rolling material and an arrow shows the rolling direction.

That is, the rolling material S rolled between the rolling rolls 5*a* and 5*b* of the first-stage stand 2 is threaded on the shape detection device 4 and is rolled between the rolling rolls 7*a* and 7*b* of the second-stage rolling stand 3, and thereafter it is conveyed to a predetermined device.

Next, the shape detection device 4 will be described by referring to FIGS. 2 to 7.

As shown in FIGS. 2(*a*) and 2(*b*), the shape detection device 4 is provided with a supporting shaft 12 which is connected with a driving motor 11 and is extended in the width direction of the rolling material S. This supporting shaft 12 supports a table 13. The table 13 is formed of a guiding member 14 for guiding the rolling material S and a guide supporting member 15 for supporting this guiding member 14. On a surface on a downstream side of the rolling direction of the guide supporting member 15, seven detectors 17 are supported. Then, a bearing 18 supported by a frame, which is not shown, is provided on the supporting shaft 12 on both sides of the table 13.

As shown in FIG. 3, the detector 17 is provided with a split roll 23 which is rotated in cooperation with the rolling material S when it comes in contact with the rolling material S, a pair of supporting arms 24*a* and 24*b* for supporting the split roll 23 between ends thereof, and a fixing member 25 which supports the other ends of these supporting arms 24*a* and 24*b* and is supported by a guide supporting member 15 of the table 13.

The split roll 23 is rotatably supported between the supporting arms 24*a* and 24*b* through self-aligning bearings 26*a* and 26*b* (as long as it is a bearing capable of rotating in a spherical form, it can be any one) provided at ends of the supporting arms 24*a* and 24*b*. In addition, the fixing member 25 is passed through by the supporting shaft 27. One end 27*a* and the other end 27*b* of this supporting shaft 27 are supported by the self-aligning bearings 28*a* and 28*b* (as long as it is a bearing, it can be any one) provided at the other ends of the supporting arms 24*a* and 24*b*. Then, between the other ends of the supporting arms 24*a* and 24*b* and the fixing member 25, ring-shaped detectors 29*a* and 29*b* are interposed. The supporting shaft 27 is passed through an opening portion of the torque detectors 29*a* and 29*b*. In addition, the torque detectors 29*a* and 29*b* are connected with the above-mentioned meandering amount computing unit 41.

Next, the description will be given of an attachment structure of the detector 17 by referring to FIGS. 4(*a*) and 4(*b*). As shown in FIGS. 4(*a*) and 4(*b*), in the detector 17, the fixing member 25 is fit into a groove 30 formed in the guide supporting member 15 and is fixed by two fixing bolts 31, and a liner 32 is held between the guide supporting member 15 and the fixing member 25. In addition, a supporting plate 33 is supported on the bottom surface of the guide supporting member 15, and a height adjusting bolt 34 is fastened so as to pass through from the bottom surface side to the upper surface side of this supporting plate 33.

That is, the detector 17 is made easily detachable by detaching the fixing bolts 31, and can prevent the table 13 from rattling with respect to the detector 17 by being fit into the groove 30 of the guide supporting member 15. With this, the split roll 23 can be always kept vertical. Then, the rolling direction of the rolling material S can be adjusted by changing the liner 25 so as to have a predetermined thickness, and upper and lower directions can be adjusted by adjusting the fastening amount of the height adjusting bolt 27. It is to be noted that the above-mentioned attachment structure of the detector 17 is applicable to the attachment structure of a roll unit 16.

Accordingly, when the rolling material S comes in contact with the split roll 23, a load thereof acts on the split roll 23, and then is transferred to the torque detectors 29*a* and 29*b*. In the torque detectors 29*a* and 29*b*, the inputted load is detected as moment acting on both ends of the split roll 23 to be outputted to the meandering amount computing unit 41. In the meandering amount computing unit 41, a position of a plate end of the rolling material S on the split roll 23 is computed from the inputted moment, and a meandering amount of the rolling material S (an off-line amount of the center position in a width direction of the rolling material S in relation to a traveling center position between the rolling stands 2 and 3) is computed from the position of the plate end of the rolling material S. After that, this meandering amount is outputted to the rolling controller 43. In the rolling controller 43, the rolling is performed in such a manner that a roll push-up cylinder 44 is controlled to adjust the rolling rolls 7*a* and 7*b* to reduce the meandering amount of the rolling material S using the inputted meandering amount. Then, this control is repeatedly performed.

Here, referring to FIG. 5, the description will be given of processing in the meandering amount computing unit 41 and the plate shape computing unit 42. It is to be noted that in the figure, a side on which the driving motor 11 is arranged is shown as a driving side and the other side is shown as an operating side.

As shown in FIG. 5, the rolling material S is threaded on the split rolls 23 in the direction as shown by the arrow. It is to be noted that the center of the split roll 23 arranged in the center is shown as O, whereas Y shows the center position of the width direction W of the rolling material S. This center O is congruent with the traveling center position between the rolling stands 2 and 3. In addition, Yc shows a meandering amount of the rolling material S (an off-line amount of the centers O and Y in a plate width direction X.)

First, in the meandering amount computing unit 41, it is determined that on which split roll 23 a plate end Sd on the driving side and a plate end Sw on the operating side of the rolling material S are arranged. This determination is performed according to the plate width W which is set in advance before rolling and moments $Md_1$, $Mw_1$, $Md_2$, $Mw_2$, . . . , $Md_7$, and $Mw_7$ detected by each of the torque detectors 29*a* and 29*b*. As a result, as shown in FIG. 5, it is determined that the plate end Sd of the rolling material S is arranged on the split roll 23 on the driving side, and it is determined that the plate end Sw of the rolling material S is arranged on the split roll 23 on the operating side.

Next, a meandering amount Yc of the rolling material S is computed. First, the loads added to the split rolls 23 on the driving side and the operating side by the plate ends Sd and Sw, coming in contact with the split rolls 23 are detected by the torque detectors 29*a* and 29*b* as moments $Md_1$, $Mw_1$, $Md_2$, $Mw_2$, . . . , $Md_7$, and $Mw_7$. After that, coordinates (X direction) of the plate ends Sd and Sw are obtained from a force balance formula of the moments $Md_1$ and $Mw_1$, the moments $Md_7$ and $Mw_7$, and the position where the load is added to each split roll 23. Then, the meandering amount Yc of the rolling material S is obtained from these coordinates of the plate ends Sd and Sw.

Next, in the plate shape computing unit 42, a plate shape of the rolling material S is computed. First, a tension distribution in a width direction of the rolling material S is approximated by a quartic expression by using the moments $Md_1$, $Mw_1$, $Md_2$, $Mw_2$, . . . , $Md_7$, and $Mw_7$, which are detected by each of the torque detectors 29*a* and 29*b*, and the coordinates of the plate ends Sd and Sw and the meandering amount Yc, which are inputted from the meandering amount computing unit 41. Next, each coefficient of this quartic expression is obtained by using the least-square method, and thereafter the tension distribution is obtained from a vector in the rolling direction by the coefficient. After that, the plate shape of the rolling material S is computed from this tension distribution. Furthermore, to improve the accuracy of computing the plate shape, similar computation is performed using the tension distribution computed earlier. As a result, the plate shape of the rolling material S is computed from the tension distribution newly computed. That is, in the meandering amount computing unit 41 and the plate shape computing unit 42, a meandering amount Yc and a plate shape are always computed at a predetermined time interval.

Thus, with having the above-mentioned configuration, if the rolling material S is simultaneously rolled by the first-stage stand 2 and the second-stage stand 3, the shape detection device 4 oscillates the supporting shaft 12 by driving the driving motor 11 to synchronize the rolling speeds at the both rolling stands 2 and 3, and to bring the split rolls 23 into contact with the rear surface of the rolling material S, which threads on the guiding member 14, so that the rolling material can have a loop to apply a certain tension. In addition, the shape detection device 4 transfers the load of the rolling material S, which acted on the split roll 23, to the torque detectors 29*a* and 29*b* so as to compute positions of the plate ends Sd and Sw and the meandering amount of the rolling material S from the moments $Md_1$, $Mw_1$, $Md_2$, $Mw_2$, . . . , $Md_7$, and $Mw_7$, which are detected by each of the torque detectors 29*a* and 29*b* and act on the both ends of the split roll 23. At the same time, a plate shape is computed from the tension distribution in the width direction of the rolling material S, which is obtained from the positions of the plate ends Sd and Sw and meandering amount Yc of the rolling material S. According to the meandering amount Yc and the plate shape, the bender force of the rolling rolls 5*a* and 5*b* or the rolling rolls 7*a* and 7*b* is controlled, that is, it is controlled so that the center Y of the rolling material S would be congruent with the center O, and so that the plate shape of the rolling material S would be uniform. With this, the meandering of the rolling material S can be controlled and the drawing accident at the rolling stand 2 or the rolling stand 3 can be prevented, whereas the plate shape of the rolling material S can be uniform, so that the edge waves and intermediate elongation can be prevented.

Here, since the rolling material S is heated at high temperature to be rolled, the detector 17 is also excessively heated by heat transfer from this rolling material S. For this reason, as shown in FIGS. 6(*a*) and 6(*b*), blades 35 are provided on the both sides of the split roll 23 so that cooling water C would be sprayed from a cooling device 36 onto the split roll 23 and the blades 35. With this, the split roll 23 can be cooled, and at the same time, the split roll 23 can be smoothly rotated by the strength of the cooling water C. Thus, the slipping with the rolling material S can be reduced whereas flaws and wearing-out can be reduced.

In addition, as shown in FIGS. 7(*a*) and 7(*b*), it is also possible that a plurality of grooves 37, which is extended in an axial direction of the split roll 23, is formed on the surface of the split roll 23, and the cooling water C is sprayed from the cooling device 36 towards these grooves 37. With this, the split roll 23 can be cooled, and at the same time, the split roll 23 can be smoothly rotated by the strength of the cooling water C. Thus, the slipping with the rolling material S can be reduced, whereas flaws and wearing-out can be reduced. Of course, the cooling structure of FIGS. 6 and 7 may be applied to a roll 20.

In addition, there is also a possibility that the torque detectors 29*a* and 29*b* are heated by the heat transfer (heat conduction and radiation) from the rolling material S. For this reason, it is also possible that a cooling path, though it is not shown in the figure, is formed in the fixing member 25 so that a cooling medium would circulate. With this, the torque detectors 29*a* and 29*b* are not kept at high temperature. Thus, damages by the heat can be prevented and at the same time detection can be performed with high accuracy.

Furthermore, it is also possible that a mixture of a lubricating oil and air would be fed into the self-aligning bearings 26*a*, 26*b*, 28*a*, and 28*b* so as to prevent the self-aligning bearings 26*a*, 26*b*, 28*a*, and 28*b* from being short of oil or from the entry of dust.

It is to be noted that in the present embodiment, the torque detectors 29*a* and 29*b* are provided between the supporting arms 24*a* and 24*b* and the fixing member 25 through the supporting shaft 27 and the self-aligning bearings 28*a* and 28*b*. However, it is also possible to provide a circular torque detector not through the supporting shaft 27 and the self-aligning bearings 28*a* and 28*b*. Furthermore, the roll benders 44 are provided as control actuators, but, a roll cloth, a roll shift, a variable crown roll, or the like can be provided according to the type of the roller.

Thus, the roller according to the present invention is provided with a plurality of the split rolls 23 provided in the width direction of the rolling material S traveling between the rolling stands 2 and 3; the table 13 which guides the rolling material S and is rotatably supported; the fixing member 25 supported by the table 13; the torque detectors 29*a* and 29*b* which separately detect loads of the rolling material S acting on the both ends of the split rolls 23 when the rolling material S comes in contact with the split rolls 23 as the moments $Md_1$, $Mw_1$, $Md_2$, $Mw_2$, . . . , $Md_7$, and $Mw_7$; the supporting arms

24*a* and 24*b* of which one end rotatably supports the split roll 23 and the other end is supported by the fixing member 25 through the torque detectors 29*a* and 29*b*; the meandering amount computing unit 41 for computing the positions and meandering amount Yc of the plate ends Sd and Sw of the rolling material S using the detected moments $Md_1$, $Mw_1$, $Md_2$, $Mw_2$, . . . , $Md_7$, and $Mw_7$; the plate shape computing unit 50 for computing the plate shape of the rolling material S using the detected moments $Md_1$, $Mw_1$, $Md_2$, $Mw_2$, . . . , $Md_7$, and $Mw_7$ and the positions and meandering amount Yc of the plate ends Sd and Sw of the rolling material S; and the roll benders for controlling the meandering and plate shape of the rolling material S according to the meandering amount Yc and the plate shape. With this, the meandering of the rolling material S can be controlled and the drawing accident due to the meandering can be prevented, whereas the plate shape of the rolling material S can be uniform, and thus edge waves and intermediate elongation can be suppressed. In addition, since the rolling is always performed while correcting the plate shape, yield is excellent and a quality thereof is improved. Furthermore, there is no need to provide another meandering detector, so that equipment spending can be reduced.

In addition, the supporting shaft 27 for supporting the detectors 29*a* and 29*b* is provided to the fixing member 25 to cause the self-aligning bearings 28*a* and 28*b* provided on the supporting arms 24*a* and 24*b* to support one end 27*a* and the other end 27*b*. With this, the shearing force does not act on the torque detectors 29*a* and 29*b* even if the rolling material S comes in contact with the split rolls 23, so that detection can be performed with high accuracy. Furthermore, there is no preload to the torque detectors 29*a* and 29*b*, so that hysteresis can be prevented.

Moreover, the plate shape is approximated to a polynomial of the tension distribution in the plate width direction of the rolling direction tension using the meandering amount Yc, and the bender force is controlled according to the polynomial and the meandering amount, so that a rolling material S with high accuracy can be produced.

INDUSTRIAL APPLICABILITY

The present invention is applicable to a looper provided between adjacent rollers.

The invention claimed is:

1. A shape detection device, characterized by comprising:

a plurality of split rolls provided in a width direction of a traveling strip;

a table which guides the strip and which is rotatably supported;

a fixing member supported by the table;

a reactive force detector for separately detecting reactive forces acting on both ends of the split rolls when the strip comes in contact with the split rolls;

a supporting arm that has a first end rotatably supporting the split roll and a second end supported by the fixing member through the reactive force detector;

a meandering amount computing unit for computing a meandering amount of the strip on a basis of the reactive forces detected by the reactive force detector; and a plate shape computing unit for computing a plate shape on the basis of the reactive forces detected by the reactive force detector and the meandering amount computed by the meandering amount computing unit.

2. A rolling mill, characterized by comprising:

a plurality of split rolls provided in a width direction of a traveling rolling material;

a table which guides the rolling material and which is rotatably supported;

a fixing member supported by the table;

a reactive force detector for separately detecting reactive forces acting on both ends of the split rolls when the rolling material comes in contact with the split rolls;

a supporting arm, one end of which rotatably supports the split roll, and an other end of which is supported by the fixing member through the reactive force detector;

a meandering amount computing unit for computing a meandering amount of the rolling material on a basis of the reactive forces detected by the reactive force detector;

a plate shape computing unit for computing a plate shape on the basis of the reactive forces detected by the reactive force detector and the meandering amount computed by the meandering amount computing unit; and a control actuator for controlling meandering and a shape of the rolling material according to the meandering amount computed by the meandering amount computing unit and the plate shape computed by the plate shape computing unit.

3. A shape detecting method, characterized by comprising:

bringing a plurality of split rolls provided in a width direction of a traveling strip into contact with the strip; separately detecting reactive forces acting on a split roll at each end of the plurality of split rolls; obtaining a meandering amount of the strip on a basis of these separately-detected reactive forces; and obtaining a plate shape of the strip on a basis of the detected reactive forces and the meandering amount.

4. A rolling method, characterized by comprising:

bringing a plurality of split rolls provided in a width direction of a traveling rolling material into contact with the rolling material; separately detecting reactive forces acting on a split roll at each end of the plurality of split rolls; obtaining a meandering amount of the rolling material from these separately-detected reactive forces; obtaining a plate shape of the rolling material from the separately-detected reactive forces and the meandering amount; and controlling a bender force of rolling mills according to the meandering amount and the plate shape.

5. The rolling method according to claim 4, characterized in that the plate shape is approximated to a polynomial of a tension distribution in a plate width direction of a rolling direction tension by using the meandering amount, and the bender force of rolling mills is controlled using the polynomial and the meandering amount.

* * * * *